US007682006B2

(12) United States Patent
Katsumura

(10) Patent No.: US 7,682,006 B2
(45) Date of Patent: Mar. 23, 2010

(54) LIQUID CONTAINER

(75) Inventor: Takayoshi Katsumura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 606 days.

(21) Appl. No.: 11/566,826

(22) Filed: Dec. 5, 2006

(65) Prior Publication Data

US 2007/0126827 A1 Jun. 7, 2007

(30) Foreign Application Priority Data

Dec. 6, 2005 (JP) ..... 2005-352623
Aug. 12, 2006 (JP) ..... 2006-220761

(51) Int. Cl.
*B41J 2/175* (2006.01)

(52) U.S. Cl. ..... 347/86

(58) Field of Classification Search ..... 347/7, 347/85, 86, 87

See application file for complete search history.

(56) References Cited

U.S. PATENT DOCUMENTS 6,042,224 A * 3/2000 Oda et al. ..... 347/86
6,196,671 B1 * 3/2001 Breemes et al. ..... 347/86
6,736,496 B2 * 5/2004 Hanaoka et al. ..... 347/86
6,905,199 B2 * 6/2005 Miyazawa et al. ..... 347/86
7,090,341 B1 * 8/2006 Miyazawa ..... 347/85
2004/0056910 A1 3/2004 Usui et al.

FOREIGN PATENT DOCUMENTS

EP 1 016 533 A1 7/2000
JP 08-174860 A 7/1996

OTHER PUBLICATIONS

Extended European Search Report issued on Oct. 1, 2009 for European Patent Appln. No. 06125530.3.

* cited by examiner

*Primary Examiner*—Anh T. N. Vo
(74) *Attorney, Agent, or Firm*—Stroock & Stroock & Lavan LLP

(57) ABSTRACT

A liquid container detachably mounted on a liquid consuming device, the liquid container includes: a liquid containing portion; a liquid supply portion that is connected to the liquid consuming device; a liquid guide path that guides a liquid stored in the liquid containing portion to the liquid supply portion; and an air communicating hole that introduces air from the outside into the liquid containing portion according to consumption of the liquid in the liquid containing portion, wherein the liquid containing portion includes a first inner wall surface, a second inner wall surface that crosses the first inner wall surface, and a liquid containing portion outlet port that is provided in the first inner wall surface close to the second inner wall surface so as to cause the liquid containing portion to communicate with the liquid guide path.

12 Claims, 5 Drawing Sheets

LIQUID CONTAINER

BACKGROUND

1. Technical Field

The present invention relates to a liquid container of an air-open type that is suitably used as an ink cartridge to be detachably mounted on an ink jet printer, and in particular, to a technique that can a good ink sweeping capability and suppress bubble leakage.

2. Related Art

In an ink jet printer, an ink jet type printing head that causes ink droplets to be ejected from nozzle openings by applying a pressure to a pressure generating chamber communicating with a common ink chamber and the nozzle openings, and an ink cartridge that supplies ink to the printing head are mounted on a carriage. Then, the ink droplets are ejected onto a recording paper according to printing data, while the carriage reciprocates.

By the way, the nozzle openings of the printing head are located at positions lower than a liquid level of ink of the ink cartridge. Accordingly, since a head pressure acts on the nozzle openings, in general, in order to prevent bleeding of ink from the nozzle openings, a porous body is accommodated in the ink cartridge, and a pressure of the ink cartridge is slightly lower than the nozzle openings according to a surface tension by the porous body.

By the way, if the quantity of ink absorbed by the porous body decreases along with ink consumption, the surface tension of the porous body increases, and thus the supply of ink to the printing head may be delayed, and ink in the ink cartridge may be not completely consumed. In addition, since ink that can be contained in the cartridge decreases by the amount corresponding to the substantial volume of the porous body, the ink cartridge may become large.

In order to solve such an inconsistency, there is an ink cartridge for an ink jet printer disclosed in Patent Document 1.

In the ink cartridge for an ink jet printer, a container having an ink supply port at its bottom surface is divided such that an ink chamber and an ink supply chamber are formed on upper and lower sides by a film valve seat formed of an elastic thin film having a through hole at its central portion. Further, a valve body is provided at a position facing the through hole, and the film valve seat is brought into contact with the valve body by a difference in pressure of the ink chamber and the ink supply chamber.

Accordingly, a differential pressure is applied to the film valve seat over a wide area, and thus a flow passage from the ink chamber to the ink supply chamber is opened corresponding to slight ink consumption. Then, ink is discharged to the printing head, without applying an excessive negative pressure to the printing head, and an increase in pressure of the ink supply chamber is absorbed into the ink chamber by deformation of the film valve seat. Therefore, ink of the ink chamber can be stably and reliably supplied to the printing head, without using the porous body.

Patent Document 1:JP-A-8-174860

In the above-described known ink cartridge for an ink jet printer, the film valve seat is provided, and the inside of the liquid containing portion is divided by many partition walls so as to form the flow passage. Then, a negative pressure is generated, without providing the porous body in the liquid containing portion, such that the quantity of ink to be contained increases. In this case, however, ink may remain at corners of the liquid containing portion or complex parts, and thus residual ink may occur. In addition, since the porous body is removed, when the ink cartridge in use is separated from the carriage and vibrates or when the ink cartridge is erroneously dropped, air in the liquid containing portion may flow downstream, and bubbles flow into the printing head. As a result, bubble leakage resistance becomes low.

SUMMARY

An advantage of some aspects of the invention is to provide a liquid container, in which a liquid rarely remains at corners or complex parts, and air in a liquid containing portion rarely flows downstream. The advantage can be attained as at least one of the following aspects:

A first aspect of the invention provides a liquid container detachably mounted on a liquid consuming device, the liquid container comprising: a liquid containing portion; a liquid supply portion that is connected to the liquid consuming device; a liquid guide path that guides a liquid stored in the liquid containing portion to the liquid supply portion; and an air communicating hole that introduces air from the outside into the liquid containing portion according to consumption of the liquid in the liquid containing portion, wherein the liquid containing portion includes a first inner wall surface, a second inner wall surface that crosses the first inner wall surface, and a liquid containing portion outlet port that is provided in the first inner wall surface close to the second inner wall surface so as to cause the liquid containing portion to communicate with the liquid guide path.

According to the liquid container having the above-described configuration, if the liquid quantity in the liquid containing portion decreases, a residual liquid is likely to be collected at a corner between the first inner wall surface and the second inner wall surface according to a surface tension by a capillary phenomenon, and the liquid containing portion outlet port is provided in the first inner wall surface at the corner.

Accordingly, the residual liquid is easily discharged to the liquid guide path through the liquid containing portion outlet port. Further, when the liquid in the liquid containing portion gradually decreases, the residual liquid is likely to be collected in the liquid containing portion outlet port. Therefore, in a state where the residual liquid exists in the liquid containing portion, air is rarely discharged from the liquid containing portion outlet port earlier.

When the internal space of the liquid containing portion is a flat space that vertically extends (that is, when the internal space is wide in a heightwise direction and narrow in a widthwise direction), if the bottom surface of the liquid containing portion serves as the second inner wall surface, one of both side walls with the flat space interposed therebetween becomes the first inner wall surface, thereby providing the liquid containing portion outlet port. The liquid containing portion outlet port is opened at the side wall in the widthwise direction, to which an impact by stirring is rarely applied when the container main body is manually stirred, and thus bubble leakage can be further prevented.

In the liquid container having the above-described configuration, the liquid containing portion outlet port is preferably provided in a region inside a meniscus that is formed at a corner between the first inner wall surface and the second inner wall surface by the liquid contained in the liquid containing portion.

According to this configuration, the liquid containing portion outlet port is disposed inside the meniscus that is formed at the corner to have different shapes and sizes according to physical properties of a liquid (in particular, viscosity and so on) to be contained in the liquid containing portion. Therefore, the liquid that is collected at the corner by the surface tension can be reliably drained, and an optimum discharge effect according to the liquid to be contained can be obtained.

A second aspect of the invention provides a liquid container detachably mounted on a liquid consuming device, the liquid container comprising: a liquid containing portion; a liquid supply portion that is connected to the liquid consuming device; a liquid guide path that guides a liquid stored in the liquid containing portion to the liquid supply portion; and an air communicating hole that introduces air from the outside into the liquid containing portion according to consumption of the liquid in the liquid containing portion, wherein the liquid containing portion includes a first inner wall surface, a second inner wall surface that crosses the first inner wall surface, and a liquid containing portion outlet port that is provided in the first inner wall surface close to the second inner wall surface so as to cause the liquid containing portion to communicate with the liquid guide path, and wherein a part of a meniscus that can be formed at a corner between the first inner wall surface and the second inner wall surface by the liquid contained in the liquid containing portion seals the liquid containing portion outlet port.

According to the liquid container having the above-described configuration, if the liquid quantity in the liquid containing portion decreases, a residual liquid is collected at a corner between the first inner wall surface and the second inner wall surface according to a surface tension by a capillary phenomenon so as to form a meniscus, and the liquid containing portion outlet port is provided in the first inner wall surface at the corner.

Accordingly, the residual liquid is easily discharged to the liquid guide path through the liquid containing portion outlet port. Further, when the liquid in the liquid containing portion gradually decreases, a part of the meniscus of the residual liquid is likely to be collected so as to seal the liquid containing portion outlet port. Therefore, in a state where the residual liquid exists in the liquid containing portion, air is rarely discharged from the liquid containing portion outlet port earlier.

When the internal space of the liquid containing portion is a flat space that vertically extends (that is, when the internal space is wide in a heightwise direction and narrow in a widthwise direction), if the bottom surface of the liquid containing portion serves as the second inner wall surface, one of both side walls with the flat space interposed therebetween becomes the first inner wall surface, thereby providing the liquid containing portion outlet port. The liquid containing portion outlet port is opened at the side wall in the widthwise direction, to which an impact by stirring is rarely applied when the container main body is manually stirred, and thus bubble leakage can be further prevented.

Further, the liquid containing portion outlet port is sealed by a part of the meniscus that is formed at the corner to have different shapes and sizes according to physical properties of a liquid (in particular, viscosity and so on) to be contained in the liquid containing portion. Therefore, the liquid that is collected at the corner by the surface tension can be reliably drained, and an optimum discharge effect according to the liquid to be contained can be obtained.

A third aspect of the invention provides a liquid container detachably mounted on a liquid consuming device, the liquid container comprising: a liquid containing portion; a liquid supply portion that is connected to the liquid consuming device; a liquid guide path that guides a liquid stored in the liquid containing portion to the liquid supply portion; and an air communicating hole that introduces air from the outside into the liquid containing portion according to consumption of the liquid in the liquid containing portion, wherein the liquid containing portion includes a first inner wall surface, a pair of inner wall surfaces that cross the first inner wall surface and face each other, and a liquid containing portion outlet port that is provided in the first inner wall surface between the pair of inner wall surfaces so as to cause the liquid containing portion to communicate with the liquid guide path.

According to the liquid container having the above-described configuration, if the liquid quantity in the liquid containing portion decreases, a residual liquid is likely to be collected between the pair of adjacent inner wall surfaces facing each other by the capillary phenomenon. The liquid containing portion outlet port is provided in the first inner wall surface between the pair of inner wall surfaces.

Accordingly, the residual liquid can be easily discharged to the liquid guide path through the liquid containing portion outlet port. Further, when the liquid in the liquid containing portion gradually decreases, the residual liquid is likely to be collected in the liquid containing portion outlet port. Therefore, in a state where the residual liquid exists in the liquid containing portion, air is rarely discharged from the liquid containing portion outlet port earlier.

In the liquid container having the above-described configuration, the liquid containing portion outlet port is preferably provided in a region of a meniscus that is formed between the pair of inner wall surfaces by the liquid contained in the liquid containing portion.

According to the liquid container having the above-described configuration, the liquid containing portion outlet port is sealed by a part of the meniscus that is formed between the pair of inner wall surfaces to have different shapes and sizes according to physical properties of a liquid (in particular, viscosity and so on) to be contained in the liquid containing portion. Therefore, the liquid that is collected at the pair of the inner wall surfaces by the surface tension can be reliably drained, and an optimum discharge effect according to the liquid to be contained can be obtained.

A fourth aspect of the invention provides a liquid consuming device, the liquid container comprising: a liquid containing portion; a liquid supply portion that is connected to the liquid consuming device; a liquid guide path that guides a liquid stored in the liquid containing portion to the liquid supply portion; and an air communicating hole that introduces air from the outside into the liquid containing portion according to consumption of the liquid in the liquid containing portion, wherein the liquid containing portion includes a first inner wall surface, a pair of inner wall surfaces that cross the first inner wall surface and face each other, and a liquid containing portion outlet port that is provided in the first inner wall surface between the pair of inner wall surfaces so as to cause the liquid containing portion to communicate with the liquid guide path, and wherein a part of a meniscus that can be formed between the pair of inner wall surfaces by the liquid contained in the liquid containing portion seals the liquid containing portion outlet port.

According to the liquid container having the above-described configuration, if the liquid quantity in the liquid containing portion decreases, a residual liquid is collected between the pair of inner wall surfaces according to a surface tension by a capillary phenomenon so as to form a meniscus, and the liquid containing portion outlet port is provided in the first inner wall surface between the pair of inner wall surfaces.

Accordingly, the residual liquid is easily discharged to the liquid guide path through the liquid containing portion outlet port. Further, when the liquid in the liquid containing portion gradually decreases, a part of the meniscus of the residual liquid is likely to be collected so as to seal the liquid containing portion outlet port. Therefore, in a state where the residual liquid exists in the liquid containing portion, air is rarely discharged from the liquid containing portion outlet port earlier.

In the liquid container having the above-described configuration, an opposing wall is preferably provided on an upstream side of an influent liquid of the liquid containing portion outlet port with a liquid inflow gap.

According to this configuration, even if the container main body in use is attached/detached to/from the liquid consuming device, and even if air and liquid in the liquid containing portion are stirred due to manual vibration, air and liquid flowing by stirring almost collide against the opposing wall, and an impact that is directly applied to the liquid containing portion outlet port is reduced by the collision. Therefore, bubble leakage from the liquid containing portion outlet port can be effectively prevented.

In the liquid container having the above-described configuration, the first inner wall surface is preferably a bottom surface of the liquid containing portion in a state where the container main body is mounted on the liquid consuming device.

According to this configuration, since the first inner wall surface becomes the bottom surface of the liquid containing portion, a surface on which the residual liquid is most likely to remain becomes the first inner wall surface. Accordingly, the last residual liquid can be guided to the liquid containing portion outlet port, and thus drainage capability of the residual liquid can be improved. Further, sweeping capability of the liquid can be improved.

In the liquid container having the above-described configuration, the liquid containing portion outlet port is preferably a small round hole to an extent that a meniscus is formed by the liquid stored in the liquid containing portion.

According to this configuration, a strong meniscus is formed at the liquid containing portion outlet port by the surface tension. Then, even if the residual liquid in the liquid containing portion decreases, or even if air and liquid in the liquid containing portion are stirred due to manual vibration, the meniscus formed at the liquid containing portion outlet port serves as an obstacle, and thus bubble leakage from the liquid containing portion outlet port can be prevented.

In the liquid container having the above-described configuration, a liquid detecting unit is preferably provided in the liquid guide path and detects an inflow of air into the liquid guide path so as to detect that the liquid of the liquid containing portion is exhausted to a predetermined amount.

According to this configuration, even if the liquid detecting unit is provided in the liquid guide path, erroneous detection due to a bad liquid sweeping capability or bubbles during the use can be prevented, and thus detection accuracy of the liquid detecting unit can be improved.

According to the liquid container of at least one of the aspects of the invention, if the liquid quantity in the liquid containing portion decreases, the residual liquid is collected at the corner that is sandwiched between the first inner wall surface and the second inner wall surface or the pair of inner wall surfaces facing each other according to the surface tension by the capillary phenomenon to form a meniscus. The liquid containing portion outlet port is provided in the first inner wall surface at the corner.

Accordingly, the residual liquid is easily discharged to the liquid guide path through the liquid containing portion outlet port. Further, when the liquid of the liquid containing portion decreases, a part of the meniscus of the residual liquid is likely to be collected at the liquid containing portion outlet port, and thus air is rarely discharged from the liquid containing portion outlet port earlier in a state where the residual liquid exists in the liquid containing portion.

Therefore, the liquid rarely remains in the liquid containing portion, and air in the liquid containing portion rarely flows downstream. As a result, liquid sweeping capability and bubble leakage resistance of the liquid container can be improved.

The present disclosure relates to the subject matter contained in Japanese patent application Nos. 2005-352623 filed on Dec. 6, 2005 and 2006-220761 filed on Aug. 12, 2006, which are expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
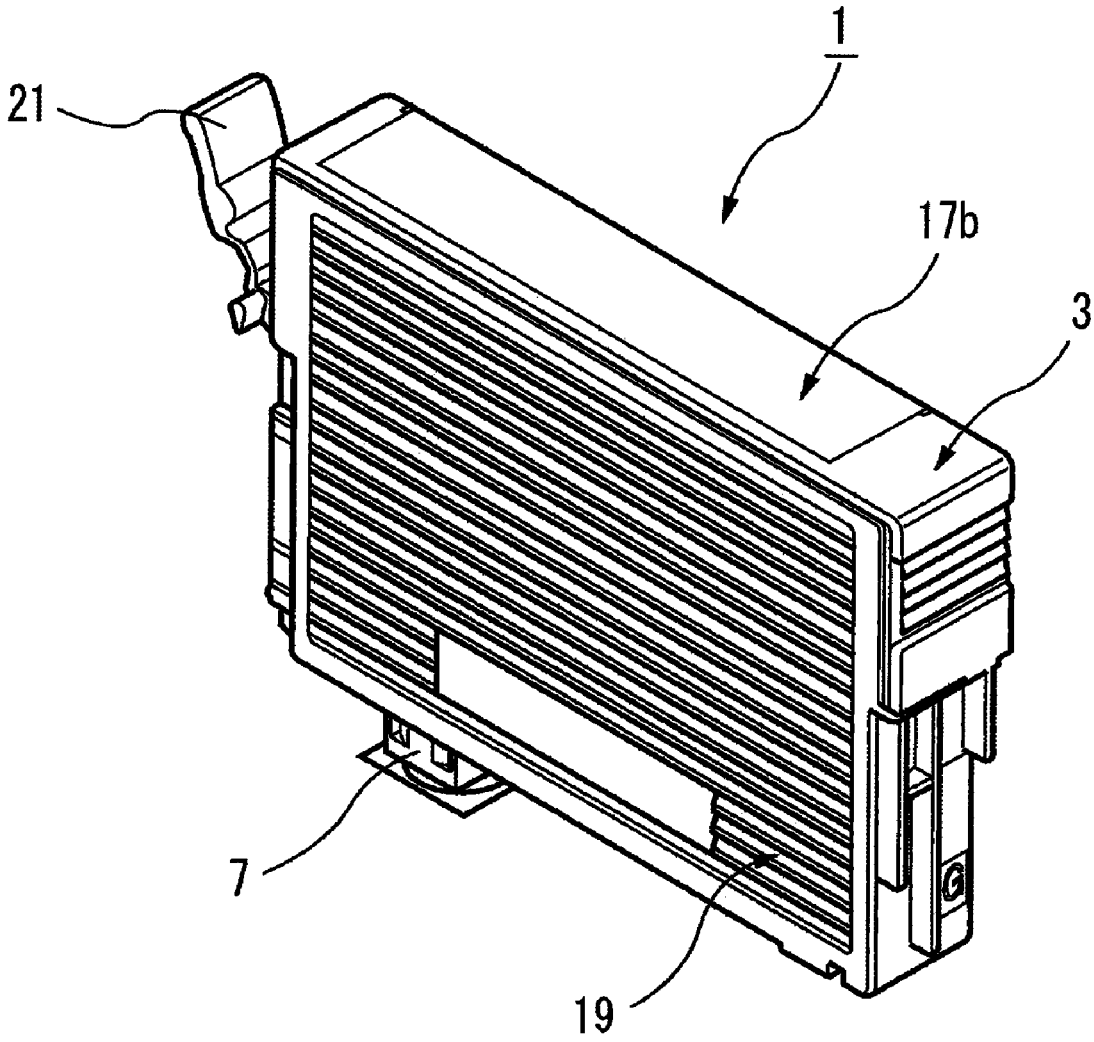
FIG. 1 is an exterior perspective view of a liquid container according to an embodiment of the invention.
Figure 2:
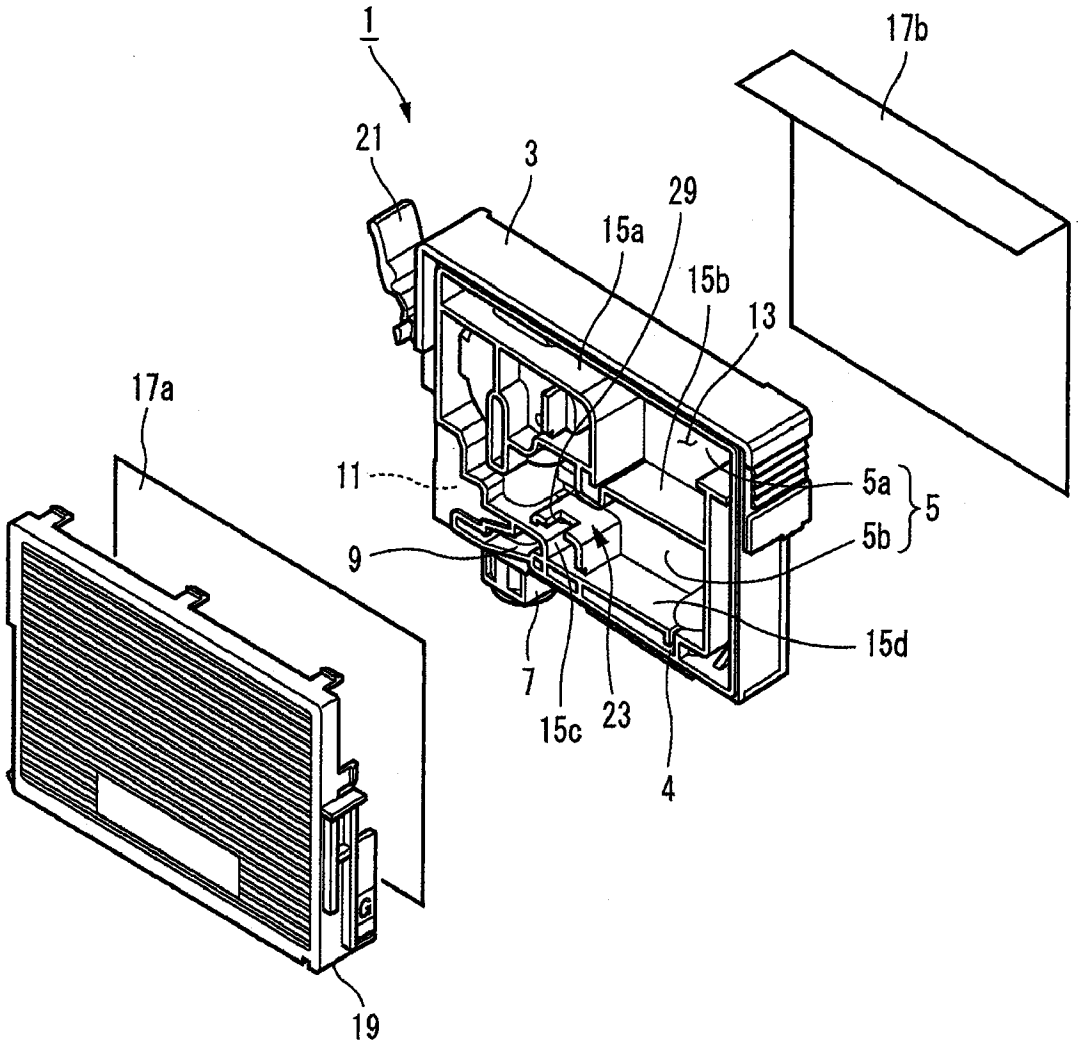
FIG. 2 is an exploded perspective view of the liquid container shown in FIG. 1.
Figure 3:
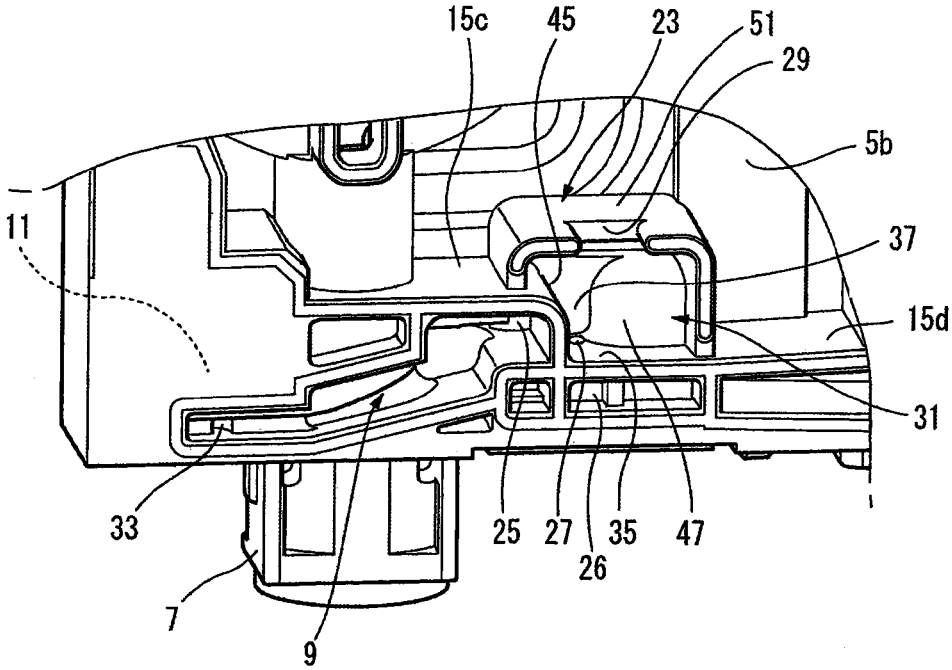
FIG. 3 is an expanded perspective view of the liquid container shown in FIG. 2.
Figure 4:
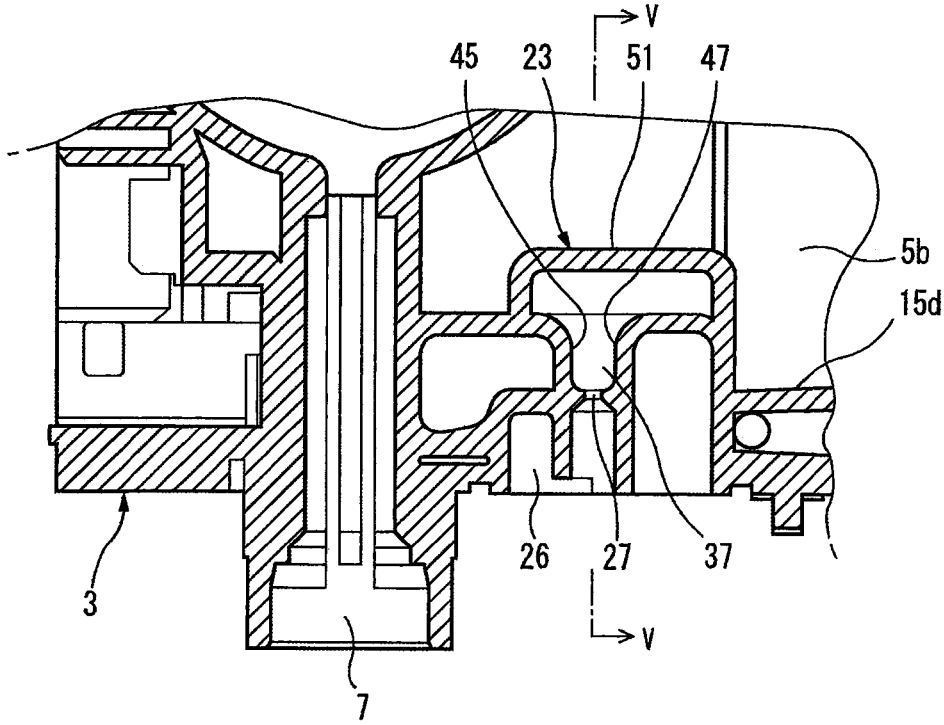
FIG. 4 is an expanded cross-sectional view of the liquid container shown in FIG. 3.
Figure 5:
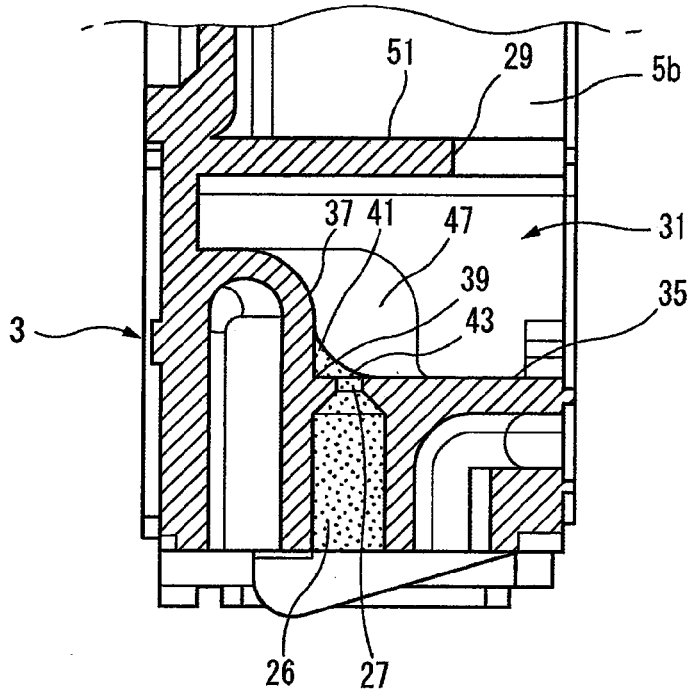
FIG. 5 is a cross-sectional view taken along the line V-V of FIG. 4.
Figure 6:
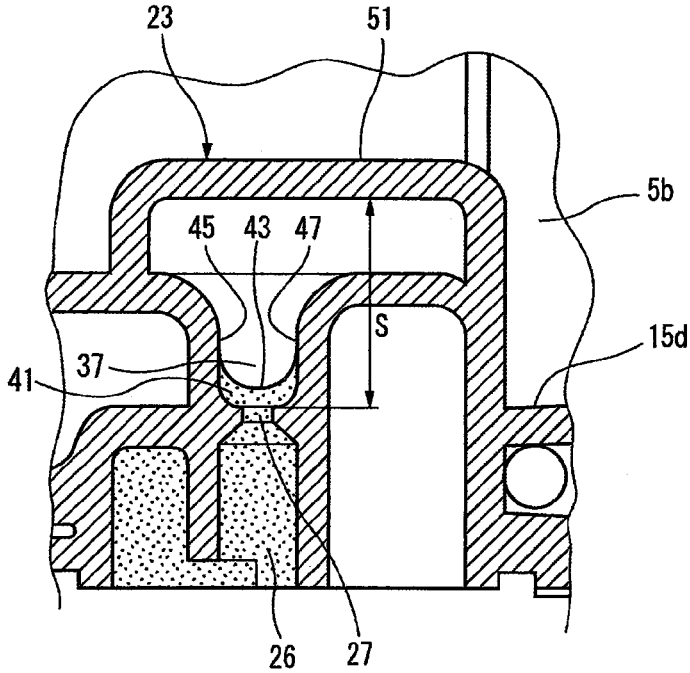
FIG. 6 is an expanded cross-sectional view of the periphery of a liquid containing portion outlet port in FIG. 4.

Hereinafter, a liquid container according to an embodiment of the invention will be described in detail with reference to the accompanying drawings. FIG. 1 is an exterior perspective view of a liquid container according to an embodiment of the invention. FIG. 2 is an exploded perspective view of the liquid container shown in FIG. 1. FIG. 3 is an expanded perspective view of the liquid container shown in FIG. 2. FIG. 4 is an expanded cross-sectional view of the liquid container shown in FIG. 3. FIG. 5 is a cross-sectional view taken along the line V-V of FIG. 4. FIG. 6 is an expanded cross-sectional view of the periphery of a liquid containing portion outlet port in FIG. 4.

As shown in FIG. 1, an ink cartridge 1 according to this embodiment is a liquid container that is detachably mounted on a cartridge mounting portion on a carriage, on which a printing head serving as a liquid jetting unit is mounted, in an ink jet printer (not shown).

As shown in FIG. 2, the ink cartridge 1, which is an air-open type ink cartridge, includes, in a container main body 3 to be mounted on a cartridge mounting portion of an ink jet printer (liquid consuming device), an ink containing portion (liquid containing portion) 5 that has an upper storage portion 5*a* and a lower storage portion 5*b* for storing ink (liquid), an ink supply portion 7 that is connected to the printing head of the printer, an ink guide path (liquid guide path) 9 that guides ink stored in the ink containing portion 5 to the ink supply portion 7, and an air communicating hole 4 that introduces air from the outside into the ink containing portion 5 according to consumption of ink in the ink containing portion 5.

In this embodiment, an ink termination sensor (liquid detecting unit) 11 is provided at a position close to the ink supply portion 7 of the ink guide path 9 and detects an inflow of air into the ink guide path 9 so as to detect that ink of the ink containing portion 5 is exhausted to a predetermined amount. The ink termination sensor 11 formed by disposing a sensor having a piezoelectric vibrating body in a sensor room formed in the ink guide path 9. If fresh air introduced from the air communicating hole 4 into the ink containing portion 5 according to ink consumption reaches a detection position of the sensor, it is detected, from a change in vibration characteristic between when the sensor room formed in the ink guide path 9 is filled with ink and when air is in contact with the periphery of the sensor, that the residual quantity of ink is zero.

In the container main body 3, partition walls 15*a*, 15*b*, 15*c*, 15*d*, . . . are formed on both sides of an intermediate wall 13. The partition walls 15*a*, 15*b*, 15*c*, 15*d*, . . . form the ink containing portion 5 and the ink guide path 9 serving as an ink flow passage. The ink containing portion 5 and the ink guide path 9 communicate with each other through a through hole (not shown), which is formed in the intermediate wall 13, over both sides of the container main body 3.

Films 17*a* and 17*b* are adhered to both sides of the container main body 3 to be close to the partition walls 15*a*, 15*b*, 15*c*, 15*d*, . . . . The films 17*a* and 17*b* close openings of both sides of the container main body 3 so as to form the ink containing portion 5 and the ink guide path 9. A cover member 19 is fitted to a surface of the container main body 3 sealed by the film 17*a*. Referring to FIG. 2, a lever 21 that attaches/detaches the ink cartridge 1 to/from the cartridge mounting portion on the carriage is provided on the outer surface of the container main body 3.

As shown in FIGS. 3 and 4, a front chamber formation wall 23 is formed in the lower storage portion 5*b*. The front chamber formation wall 23 covers an ink containing portion outlet port (liquid containing portion outlet port) 27 that communicates with an ink inlet port 25 of the ink guide path 9. A cut opening 29 is formed in the front chamber formation wall 23. Ink in the lower storage portion 5*b* passes through the cut opening 29 and flows into a front chamber 31. Ink that flows into the front chamber 31 is drained from the ink containing portion outlet port 27 to the ink inlet port 25 through a labyrinthine flow passage 26, flows the ink guide path 9, enters a liquid inflow opening 33, and passes through the ink termination sensor 11.

That is, the front chamber 31 that forms a portion of the ink containing portion 5 is provided in the lower storage portion 5*b*. As shown in FIG. 5, a corner 39 is formed in the front chamber 31 by a bottom surface 35 that serves a first inner wall surface and a side wall surface 37 that serves as a second inner wall surface and crosses the bottom surface 35. Then, the ink containing portion outlet portion 27 is formed in the bottom surface 35 to be close to the side wall surface 37.

As a specific position of the ink containing portion outlet port 27 that is formed in the bottom surface 35 to be close to the side wall surface 37, as shown in FIG. 5, a region inside a meniscus 43 formed at the corner 39 by ink 41 to be contained in the lower storage portion 5*b* of the ink containing portion 5 is exemplified.

That is, in the lower storage portion 5*b*, if the ink quantity decreases, residual ink 41 is collected at the corner 39 sandwiched between the bottom surface 35 and the side wall surface 37 according to a surface tension by a capillary phenomenon, and thus the meniscus 43 is formed.

The ink containing portion outlet port 27 is provided in the bottom surface 35 in a region inside the meniscus 43 formed at the corner 39, and thus residual ink 41 is easily discharged to the ink guide path 9 through the ink containing portion outlet port 27. Further, when ink 41 in the lower storage portion 5*b* gradually decreases, a part of a meniscus 43 of residual ink 41 is likely to be collected to seal the ink containing portion outlet port 27. Therefore, air is rarely discharged from the ink containing portion outlet port 27 earlier in a state where ink 41 exists in the lower storage portion 5*b*.

As such, since the ink containing portion outlet port 27 is disposed inside the meniscus 43 formed to have different shapes and sizes according to physical properties (in particular, viscosity and so on) of ink 41 to be contained in the ink containing portion 5, ink 41 collected at the corner 39 according to the surface tension by the capillary phenomenon can be reliably drained, and thus an optimum discharge effect according to ink 41 can be obtained.

In the ink cartridge 1 according to this embodiment, the first inner wall surface serves as the bottom surface 35 of the ink containing portion 5 when the container main body 3 is mounted on the cartridge mounting portion of the ink jet printer, and the ink containing portion outlet port 27 is provided in the bottom surface 35, on which residual ink is most likely to remain.

Therefore, last residual ink can be guided to the ink containing portion outlet port 27, and drainage capability of residual ink can be improved. Further, sweeping capability of residual ink can be improved.

Preferably, the ink containing portion outlet port 27 is a small round hole to an extent that the meniscus is formed by ink 41 contained in the ink containing portion 5. Specifically, if ink 41 having a general physical property value is used, the diameter of the round hole becomes about 0.8 mm. With the round hole, a strong meniscus is formed at the ink containing portion outlet port 27 by the surface tension. Then, even if the residual liquid in the ink containing portion 5 decreases, or even if air and liquid in the ink containing portion 5 are stirred due to manual vibration, the meniscus formed at the ink containing portion outlet port 27 serves as an obstacle, and thus bubble leakage from the ink containing portion outlet port 27 can be prevented.

As shown in FIGS. 4 and 6, a pair of side wall surfaces (a pair of inner wall surfaces) 45 and 47 that cross the bottom surface 35 serving as the first inner wall surface and face each other are provided in the front chamber 31 of the ink cartridge 1 according to the above-described embodiment. The ink containing portion outlet port 27 is formed in the bottom surface 35 between the pair of side wall surfaces 45 and 47.

Specifically, when ink 41 having a general physical property value is used, a gap between the pair of side wall surfaces 45 and 47 becomes about 2 mm. As such, since the pair of side wall surfaces 45 and 47 are disposed to face each other and to be close to each other, the meniscus 43 is easily generated between the pair of side wall surfaces 45 and 47. Therefore, a part of a meniscus 43 of residual ink 41 in the ink containing portion 5 is easily guided to seal the ink containing portion outlet port 27 by the capillary phenomenon. That is, a drainage effect of ink 41 can be further increased.

In the ink cartridge 1 according to this embodiment, as shown in FIG. 6, an opposing wall 51 is provided on an upstream side of an influent liquid of the ink containing portion outlet port 27 with a liquid inflow gap S.

The opposing wall 51 may form a portion of the front chamber formation wall 23. That is, as shown in FIG. 3, in the front chamber formation wall 23, the cut opening 29 is out of line from the ink containing portion outlet port 27.

With this configuration, even if the container main body 3 in use is attached/detached to/from the ink jet printer, and even if air and liquid in the ink containing portion 5 are stirred due to manual vibration, air and liquid flowing by stirring almost collide against the opposing wall 51, and an impact that is directly applied to the ink containing portion outlet port 27 is reduced by the collision. Therefore, bubble leakage from the ink containing portion outlet port 27 can be effectively prevented.

Therefore, according to the ink cartridge 1, the ink containing portion outlet port 27 that causes the ink containing portion 5 to communicate with the ink guide path 9 is formed in the bottom surface 35 surrounded by the side wall surface 37 crossing the bottom surface 35 of the ink containing portion 5 and the inner wall surfaces 45 and 47. Therefore, if ink 41 in the ink containing portion 5 decreases, ink 41 is likely to be collected in the periphery of the ink containing portion outlet port 27 surrounded by the side wall surface 37 and the inner wall surfaces 45 and 47 according to the surface tension by the capillary phenomenon.

Residual ink 41 in the ink containing portion 5 is easily discharged to the ink guide path 9 through the ink containing portion outlet port 27. Further, when ink in the ink containing portion 5 gradually decreases, a part of a meniscus 43 of residual ink 41 is likely to be collected to seal the ink containing portion outlet port 27. Then, air is rarely discharged from the ink containing portion outlet port 27 earlier in a state where ink 41 exists in the ink containing portion 5.

Therefore, ink 41 rarely remains in the ink cartridge 1, and air in the ink containing portion 5 rarely flows downstream. As a result, ink sweeping capability of the ink cartridge 1 and bubble leakage resistance can be improved.

With the above-described configuration, in case of the ink cartridge 1 that has the ink termination sensor 11 for detecting an inflow of air into the ink guide path 9 so as to detect that ink of the ink containing portion 5 is exhausted, it is possible to prevent occurrence of much residual ink in the ink containing portion 5 due to bad ink sweeping capability in spite of the detection of the ink termination, or to prevent erroneous detection due to bubbles during the use. Therefore, detection accuracy of the ink termination sensor 11 can be improved.

Figure 7:
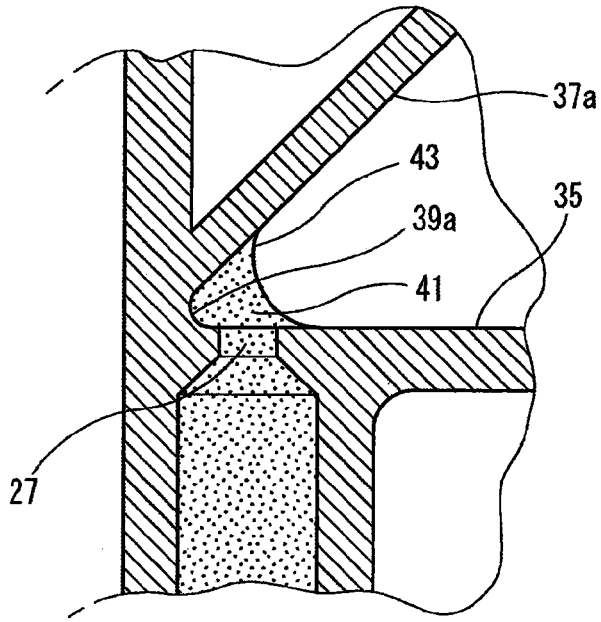
FIG. 7 is a cross-sectional view of a modification in which a second inner wall surface crosses a first inner wall surface at an acute angle.

In the above-described embodiment, the bottom surface 35 and the side wall surface 37 cross each other at right angles. Alternatively, as shown in FIG. 7, the bottom surface 35 and a side wall surface 37*a* may cross each other at an acute angle, thereby forming a corner 39A having an acute angle.

In this case, with the corner 39A having the acute angle, residual ink 41 can be collected at the corner 39A of the bottom surface 35 and the side wall surface 37*a* by a stronger surface tension and form a meniscus.

Figure 8:
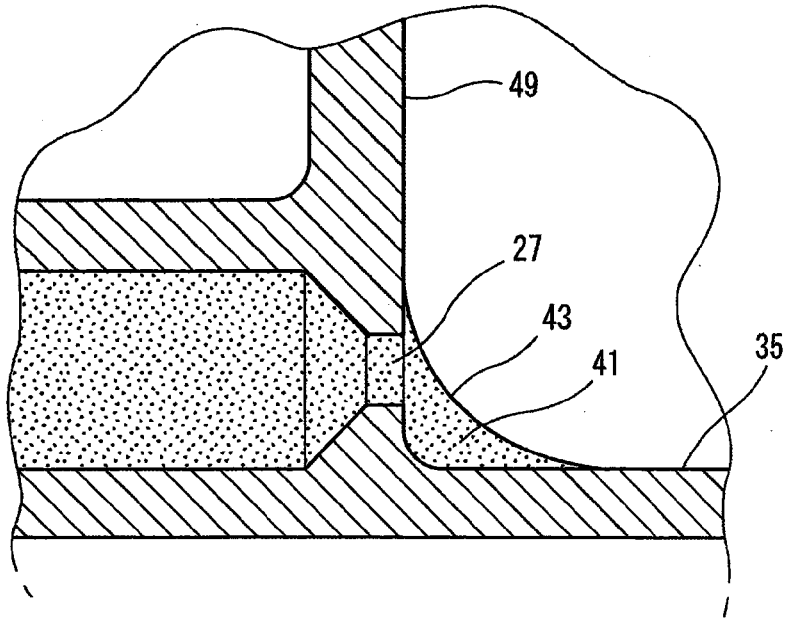
FIG. 8 is a cross-sectional view of a modification in which a liquid containing portion outlet port is provided in a side wall.

In the ink cartridge 1 of the above-described embodiment, the ink containing portion outlet port 27 is formed with the bottom surface 35 as the first inner wall surface. For example, as shown in FIG. 8, the ink containing portion outlet port 27 may be formed with a side wall surface 49 as the first inner wall surface, and the second inner wall surface crossing the side wall surface 49 may form the bottom surface 35.

In this case, like the configuration of the above-described configuration in which the ink containing portion outlet port 27 is provided in the bottom surface 35, good ink drainage effect and bubble leakage suppression effect are obtained. In addition, when the internal space of the ink containing portion 5 is a flat space that vertically extends (that is, as shown in FIG. 2, when the internal space is wide in a heightwise direction and narrow in a widthwise direction), the first inner wall surface serves as the bottom surface, and thus the ink containing portion outlet port 27 is provided in the side wall surface 49 forming the flat space.

That is, the ink containing portion outlet port 27 is opened at the side wall surface 49 in a widthwise direction, to which an impact by stirring is rarely applied when the container main body 3 is manually stirred, and thus bubble leakage can be further prevented.

The configuration of the container main body, the liquid containing portion, the liquid supply portion, the liquid guide path, the air communicating hole, the first inner wall surface, the second inner wall surface, and the liquid containing portion outlet port, and the like of the invention are not limited to the configuration of the above-described embodiment. Various changes can be made on the basis of the spirit or scope of the invention.

The use of the liquid container of the invention is not limited to the ink cartridge of the ink jet recording apparatus described above. The liquid container of the invention can be used in various liquid consuming devices having a liquid jetting head for jetting very small liquid droplets.

Specific examples of the liquid consuming device include a device having a color material jetting head used in manufacturing color filters of a liquid crystal display or the like, a device having an electrode material (conductive paste) jetting head used in forming electrodes of an organic electroluminescent (EL) display or a surface emission display (FED), a device having a bioorganic compound jetting head used in manufacturing a bio-chip, a device having a sample spraying head as a precision pipette, a textile printing device, or a micro dispenser.

What is claimed is:

1. A liquid container adapted to be detachably mounted on a liquid consuming device, the liquid container comprising:

a liquid containing portion storing liquid therein;

a liquid supply portion adapted to be connected to the liquid consuming device when the liquid container is mounted on the liquid consuming device;

a liquid guide path configured to guide the liquid stored in the liquid containing portion to the liquid supply portion; and an air communicating hole configured to introduce external air into the liquid containing portion according to consumption of the liquid in the liquid containing portion, wherein the liquid containing portion includes a first inner wall surface, a second inner wall surface that crosses the first inner wall surface to form a corner portion therebetween, and a communicating the liquid containing portion with the liquid guide path; and wherein the port is adjacent to the second inner wall surface such an extent that the port is situated inside a meniscus of the liquid that is formed at the corner portion.

2. The liquid container according to claim 1, wherein an opposing wall is provided on an upstream side of an influent liquid of the port with a liquid inflow gap.

3. The liquid container according to claim 1, wherein the first inner wall surface is a bottom surface of the liquid containing portion in a state where the container main body is mounted on the liquid consuming device.

4. The liquid container according to claim 1, wherein the port is a small round hole to an extent that a meniscus is formed by the liquid stored in the liquid containing portion.

5. The liquid container according to claim 1, wherein a liquid detecting unit is provided in the liquid guide path and detects an inflow of air into the liquid guide path so as to detect that the liquid of the liquid containing portion is exhausted to a predetermined amount.

6. The liquid container according to claim 1, the liquid containing portion further includes a third inner wall surface covering the port and formed with an opening, wherein the liquid stored in the liquid storing portion flows into the port by way of the opening.

7. A liquid container adapted to be detachably mounted on a liquid consuming device, the liquid container comprising:

a liquid containing portion storing liquid therein;

a liquid supply portion adapted to be connected to the liquid consuming device when the liquid container is mounted on the liquid consuming device;

a liquid guide path configured to guide the liquid stored in the liquid containing portion to the liquid supply portion; and an air communicating hole configured to introduce external air into the liquid containing portion according to consumption of the liquid in the liquid containing portion, wherein the liquid containing portion includes a first inner wall surface, a second inner wall surface that crosses the first inner wall surface to form a corner portion therebetween, and a communicating the liquid containing portion with the liquid guide path, and wherein the port is adjacent to the second inner wall surface such an extent that the port is situated inside a meniscus of the liquid that is formed at the corner portion and a part of the meniscus seals the port.

8. The liquid container according to claim 7, the liquid containing portion further includes a third inner wall surface covering the port and formed with an opening, wherein the liquid stored in the liquid storing portion flows into the port by way of the opening.

9. A liquid container adapted to be detachably mounted on a liquid consuming device, the liquid container comprising:

a liquid containing portion storing liquid therein;

a liquid supply portion adapted to be connected to the liquid consuming device when the liquid container is mounted on the liquid consuming device;

a liquid guide path a configured to guide the liquid stored in the liquid containing portion to the liquid supply portion; and an air communicating hole configured to introduce external air into the liquid containing portion according to consumption of the liquid in the liquid containing portion, wherein the liquid containing portion includes a first inner wall surface, a pair of second inner wall surfaces that cross the first inner wall surface and face each other, and a port provided in the first inner wall surface and communicating the liquid containing portion with the liquid guide path; and wherein an interval between the second inner wall surfaces is such an extent that a meniscus of the liquid is formed therebetween.

10. The liquid container according to claim 9, the liquid containing portion further includes a third inner wall surface covering the port and formed with an opening, wherein the liquid stored in the liquid storing portion flows into the port by way of the opening.

11. A liquid container adapted to be detachably mounted on a liquid consuming device, the liquid container comprising:

a liquid containing portion storing liquid therein;

a liquid supply portion adapted to be connected to the liquid consuming device when the liquid container is mounted on the liquid consuming device;

a liquid guide path configured to guide the liquid stored in the liquid containing portion to the liquid supply portion; and an air communicating hole configured to introduce external air into the liquid containing portion according to consumption of the liquid in the liquid containing portion, wherein the liquid containing portion includes a first inner wall surface, a pair of second inner wall surfaces that cross the first inner wall surface and face each other, and a port provided in the first inner wall surface and communicating the liquid containing portion with the liquid guide path, and wherein an interval between the second inner wall surfaces is such an extent that a meniscus of the liquid is formed therebetween so that a part of the meniscus seals the port.

12. The liquid container according to claim 11, the liquid containing portion further includes a third inner wall surface covering the port and formed with an opening, wherein the liquid stored in the liquid storing portion flows into the port by way of the opening.

* * * * *